US010234213B2

(12) United States Patent
Dupont

(10) Patent No.: US 10,234,213 B2
(45) Date of Patent: Mar. 19, 2019

(54) DEVICE FOR HEAT TRANSPORT WITH TWO-PHASE FLUID

(71) Applicant: EURO HEAT PIPES, Nivelles (BE)

(72) Inventor: Vincent Dupont, Etterbeek (BE)

(73) Assignee: EURO HEAT PIPES, Nivelles (BE)

( * ) Notice: Subject to any disclaimer, the term of this patent is extended or adjusted under 35 U.S.C. 154(b) by 673 days.

(21) Appl. No.: 14/767,887

(22) PCT Filed: Feb. 14, 2014

(86) PCT No.: PCT/EP2014/052896

§ 371 (c)(1),
(2) Date: Aug. 13, 2015

(87) PCT Pub. No.: WO2014/125064

PCT Pub. Date: Aug. 21, 2014

(65) Prior Publication Data

US 2015/0369541 A1 Dec. 24, 2015

(30) Foreign Application Priority Data

Feb. 14, 2013 (FR) ..... 13 51282

(51) Int. Cl.
*F28D 15/02* (2006.01)
*F28D 15/04* (2006.01)
*F28D 15/06* (2006.01)

(52) U.S. Cl.
CPC ..... *F28D 15/0266* (2013.01); *F28D 15/025* (2013.01); *F28D 15/043* (2013.01); *F28D 15/06* (2013.01); *F28F 2265/12* (2013.01)

(58) Field of Classification Search
CPC ..... F28D 15/025; F28D 15/043; F28D 15/06; F28D 15/0266; H05K 7/2099; H05K 7/20381; H05K 7/20936; H01L 23/427
See application file for complete search history.

(56) References Cited

U.S. PATENT DOCUMENTS 4,576,009 A 3/1986 Ogushi et al.
5,203,399 A 4/1993 Koizumi
5,816,313 A * 10/1998 Baker ..... F16K 15/048 137/519.5

(Continued)

FOREIGN PATENT DOCUMENTS

CN 1865828 A 11/2006
FR 2949642 A1 3/2011

(Continued)

*Primary Examiner* — Tho V Duong
(74) *Attorney, Agent, or Firm* — Seed IP Law Group LLP

(57) ABSTRACT

A heat transport device with a diphasic working fluid contained in a general closed circuit, includes an evaporator having a microporous body suitable for providing capillary pumping of liquid phase fluid; a condenser; a tank having an inner space, with a liquid portion and a gas portion; and an inlet/outlet arranged at the liquid portion, wherein the volume of the liquid portion can vary between a minimum volume and a maximum volume. The gas portion of the tank contains the vapor phase of the working fluid, at a first partial pressure, and a noncondensable auxiliary gas at a second partial pressure, wherein the second partial pressure is greater than the first partial pressure, at least when the liquid portion is at the minimum volume thereof.

9 Claims, 3 Drawing Sheets

(56) References Cited

U.S. PATENT DOCUMENTS

| | | | | |
|---|---|---|---|---|
| 5,944,092 | A * | 8/1999 | Van Oost | F28D 15/043 165/104.24 |
| 6,840,304 | B1 * | 1/2005 | Kobayashi | B01D 3/007 165/104.25 |
| 6,990,816 | B1 * | 1/2006 | Zuo | B64G 1/50 62/3.7 |
| 7,692,926 | B2 * | 4/2010 | Henderson | F28D 15/043 165/104.21 |
| 2004/0194929 | A1 | 10/2004 | Ippoushi et al. | |

FOREIGN PATENT DOCUMENTS

| | | | |
|---|---|---|---|
| JP | 54-131876 | A | 10/1979 |
| JP | 60-162186 | A | 8/1985 |
| JP | 60-171389 | A | 9/1985 |
| JP | S6196395 | A | 5/1986 |
| JP | 9-273876 | A | 10/1997 |
| JP | 11-108572 | A | 4/1999 |
| JP | 2013-19549 | A | 1/2013 |

* cited by examiner

DEVICE FOR HEAT TRANSPORT WITH TWO-PHASE FLUID

The present invention relates to devices for heat transport with two-phase fluid, in particular passive devices with two-phase fluid loop and with capillary pumping or using gravity.

Document FR-A-2949642 teaches an example of such a device used as means for cooling an electrotechnical power converter.

Under established operating conditions, these devices are wholly satisfactory. However, it is apparent that the phases of start up from a "cold" state (minimum ambient temperature and zero thermal flux) can be particularly delicate for significant thermal powers and can require a prior conditioning step, for example of prior heating of the tank. Without this conditioning, the pressure in the circuit can prove to be insufficient for providing sufficient heat transfer.

A need therefore appeared for improving the availability of the startup relating to such two-phase loops.

For that purpose, the subject of the invention is a device for heat transfer, without active regulation, suited for extracting heat from a hot source and for returning this heat to a cold source by means of a two-phase working fluid contained in a general closed circuit, comprising an evaporator, having an inlet and an outlet, a condenser, separate from and away from the evaporator, a tank with an internal volume, a liquid portion and a gas portion, and at least one inlet/outlet orifice arranged near the liquid portion, where the volume of the liquid portion can vary between a minimum volume Vmin and a maximum volume Vmax;

- A first connection circuit, for the working fluid essentially in vapor phase, connecting the outlet of the evaporator to the inlet of the condenser;
- A second connection circuit, for the working fluid essentially in liquid phase, connecting an outlet from the condenser to the tank and to the inlet of the evaporator; Characterized in that the gas portion from the tank includes the vapor phase of the working fluid with a first partial pressure P1 (pressure determined by the temperature of the tank) and a non-condensable auxiliary gas with a second partial pressure P2, where this partial pressure is adjusted to make it possible to obtain a total pressure greater than or equal to a preset minimum operating pressure required when the liquid portion in the entire general closed circuit is at a minimum total volume.

Because of these arrangements, in particular because of the second partial pressure P2, a minimum pressure in the tank is assured because of the presence of the non-condensable auxiliary gas in the gas portion of the tank, even when the liquid portion is at a minimum thereof, or the device is completely cold, without adding heat to the evaporator for sufficiently long time. The minimum pressure related to the presence of the non-condensable auxiliary gas in the tank serves to get a high saturation temperature in the second connection circuit (gas conduit), which makes it possible to get a minimum density of the vapor phase of the working fluid, and given that the heat transport capacity of the loop is proportional to the vapor phase density, an improved heat transport capacity can be obtained instantly upon cold startup of the loop.

Additionally, because of these arrangements, a passive regulation is obtained without need of an active control system which increases the reliability of this type of device. Such a system, without active pumping and without active control, does not require any maintenance and has a very high reliability; and the energy consumption thereof is very small or even zero.

Preferably as non-condensable auxiliary gas, a gas is chosen which remains in the gaseous state over the entire temperature/pressure range to which the device is subject; additionally a gas with a low coefficient of diffusion in the liquids is chosen as auxiliary gas.

In various embodiments of the invention, use could additionally be made of one and/or another of the following arrangements:

- The non-condensable auxiliary gas can be helium; the physical-chemical properties of helium are perfectly suited and this gas has good industrial availability;
- The working fluid can be methanol; this fluid is able to work in a satisfactory temperature range and has satisfactory capillary performance;
- The second partial pressure P2 can be at least several times greater than the first partial pressure P1 when the liquid portion is at the minimum volume thereof; such that the minimum pressure is high enough to allow an instantaneous startup under significant thermal load without preparation;
- The volume of the tank can be included between 1.3 and 2.5 times the maximum volume of the liquid portion; such that when the volume of the liquid portion is maximum, the pressure and temperature in the tank and in the loop remain limited and remain compatible with effective collection of calories near the evaporator;
- The device can be mainly subject to terrestrial gravity, where the inlet/outlet orifice is arranged near at least one low point of the tank; by means of this, aspiration of the auxiliary gas in the direction of the evaporator is avoided;
- The device can be subject mainly to microgravity, since the tank comprises a porous mass laid out at least in the area of the inlet orifice by means of which a liquid barrier is formed in the porous mass and aspiration of the auxiliary gas in the direction of the evaporator is avoided;
- The evaporator can include a micro-porous mass adapted for assuring capillary pumping of the liquid phase fluid; a passive maintenance free system is thus obtained;
- In the case where the device is subject mainly to gravity, the evaporator without capillary structure can be placed below the condenser and the tank, such that gravity is used for moving the liquid towards the evaporator, which represents a very simple and particularly robust and reliable solution;
- An anti-backflow valve can be arranged at the inlet of the evaporator; liquid backflow in the opposite direction of the normal circulation direction can thus be blocked and also block drying of the evaporator on start up under heavy load
- Advantageously according to the invention, the system has no active regulation, which provides a particularly reliable solution.

Other aspects, purposes and advantages of the invention will appear upon reading the following description of two embodiments of the invention, given as examples without limitation, with reference to the attached drawings in which.

In the various figures, the same references designate identical or similar items.

Figure 1:
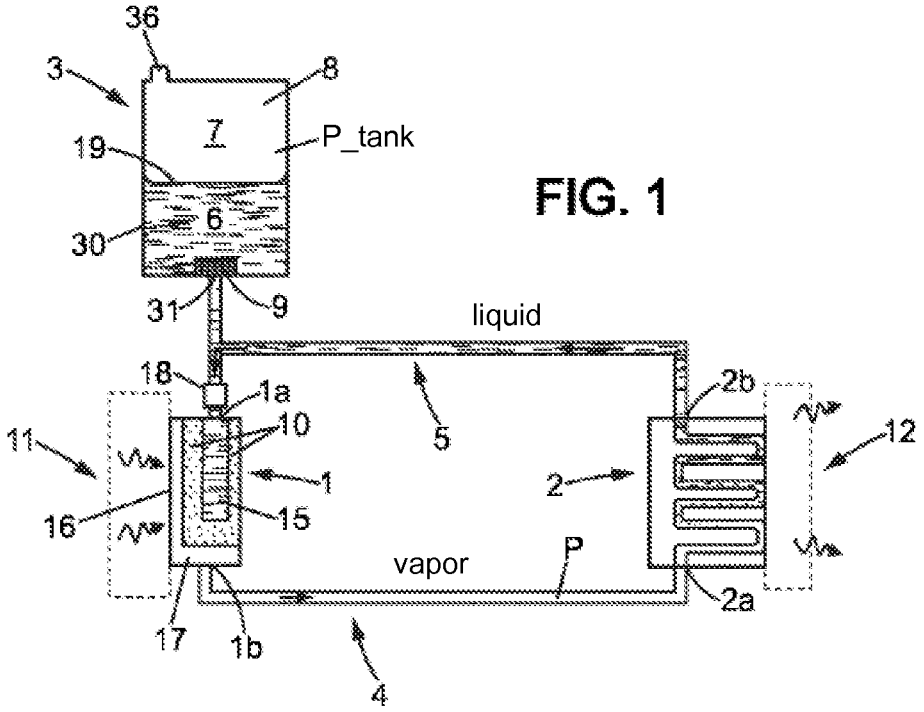
FIG. 1 shows a general view of a device according to an embodiment of the invention.

FIG. 1 shows a device for heat transport with two-phase fluid loop. In the first embodiment, pumping is provided by drawing on the capillarity phenomenon. The device includes an evaporator 1, having an inlet 1*a* and an outlet 1*b*, and a microporous mass 10 adapted for providing capillary pumping. For this purpose, the microporous mass 10 surrounds a limited central longitudinal hollow 15 connected with the inlet 1*a* in order to receive the working fluid in the liquid state.

The evaporator 1 is thermally coupled to a hot source 11, like for example an assembly comprising electronic power components or any other element generating heat, for example by resistive heating or by any other process.

Under the effect of adding calories to the contact 16 of the liquid filled microporous mass, the fluid changes from the liquid state to the vapor state and leaves by the transfer chamber 17 and by a first connection circuit 4 which routes said vapor towards condenser 2 with an inlet 2*a* and an outlet 2*b*, where the condenser 2 is distinct and not adjacent to the evaporator 1.

In the evaporator 1, the cavities cleared by the evaporated gas are filled by liquid aspirated by the microporous mass 10 from the aforementioned central hollow 15; it involves the well-known phenomenon of capillary pumping. The heat flow Q collected from the hot source corresponds to the flow rate multiplied by the latent heat of evaporation L of the working fluid ($Q=L\cdot dM/dt$).

Inside of the condenser 2, heat is given off to cold source 12 by the fluid in vapor phase, which causes a cooling of the vapor phase fluid and phase transition thereof to the liquid phase, in other words condensation thereof.

Near the condenser 2, the temperature of the working fluid is lowered below the liquid-vapor equilibrium temperature thereof, which is also called sub-cooling, such that the fluid cannot return to the vapor state without subsequent addition of heat.

Vapor pressure pushes the liquid in the direction of the outlet 2*b* of the condenser 2 which opens into a second connection circuit 5, connected to the inlet 1*a* of the evaporator 1. A circulation loop of the two-phase fluid thus results that is capable of extracting heat from the hot source 11 and releasing this heat to a cold source 12.

The heat transported by the vapor phase in the first connection circuit can be written $Q=\rho VS$, where $\rho$ represents the density of the vapor phase, V the travel speed of the vapor phase and S the cross-section of the connection circuit.

The second connection circuit 5 is also connected to a tank 3. This tank serves as an expansion vessel for the working fluid and contains working fluid in both liquid and gas phase. Along with the first and second connection circuits 4, 5 and the evaporator 1 and condenser 2, said tank forms a general, closed circuit otherwise referred to as hermetic.

The tank 3 has at least one inlet/outlet orifice 31, and some inside volume 30 generally set during design for a given application. This volume could be adjustable by a manually or automatically maneuvered mechanical device. The tank also comprises a filling orifice 36 which is used for an initial filling of the circuit, where this filling orifice is closed the remainder of the time. It should be noted that the tank 3 can have an arbitrary shape, and in particular parallelepiped, cylindrical or other.

The heat transfer device is designed in order to be able to operate in a certain ambient temperature range; in the example shown, this temperature range can be: [−50° C., +50° C.]. Additionally, it is desirable that the hot source 11 not exceed a specific preset maximum temperature whatever the heat flux to be removed. This preset maximum temperature can for example be 100° C. Of course these temperatures can depend on the type of application targeted: space applications in microgravity, terrestrial applications on board a vehicle or in a fixed location.

Figure 2:
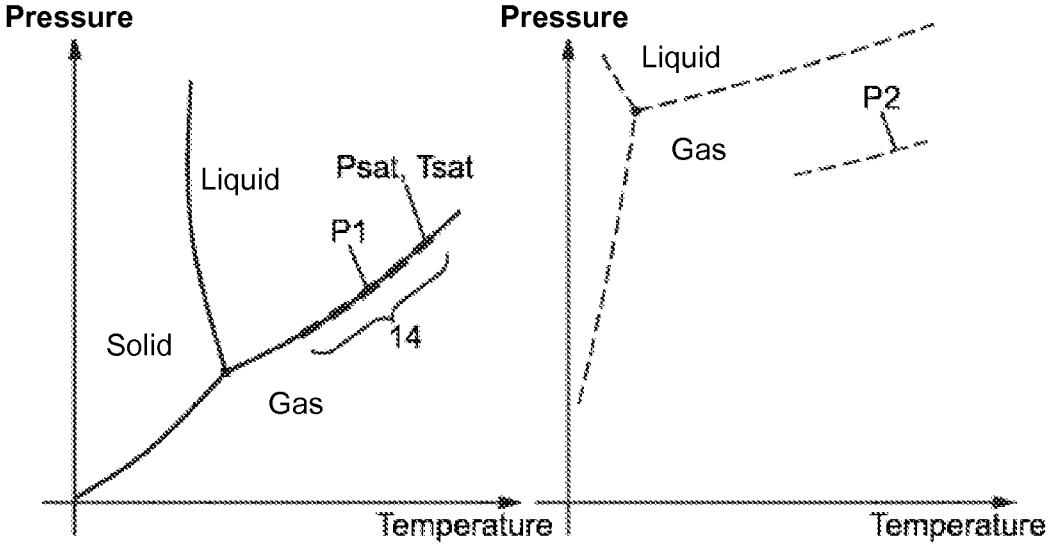
FIG. 2 shows the fluids in a general phase transition diagram.

The working fluid of the loop is chosen in order to always be potentially two-phased in the temperature and pressure range of the fluid of the two-phase loop, based on the aforementioned temperature range (see reference 14, FIG. 2).

Thus the working fluid can be chosen among a list including in particular ammonia, acetone, methanol, water, dielectric fluids of the HFE 7200 type or any other appropriate fluid. In the detailed example below, methanol will be preferably selected.

A liquid portion 6 essentially comprising the working fluid (here methanol) in liquid phase and a gas portion 7 comprising the fluid in vapor phase, but also, as will be seen in detail later, a non-condensable auxiliary gas 8 are located inside the tank 3. The non-condensable auxiliary gas 8 (noted NCG, Non-Condensable Gas) remains confined in the gas portion of the tank without directly participating in the thermal exchanges; the effect thereof is creating a minimum pressure in this gas portion. The partial pressure of this non-condensable auxiliary gas 8 is written P2. Over the temperature and pressure range of the application, this non-condensable auxiliary gas remains in the gaseous state as will be seen in FIG. 2, on the right.

It should be remarked here that according to the known prior art, the presence of non-condensable gas in the working circuit is undesirable because if bubbles of non-condensable gas get into the area of the capillary evaporator, this reduces the thermal performance of vaporization and can even go so far as loss of priming of the capillary evaporator, which can be catastrophic in certain critical applications.

In an environment with gravity, the gas portion 7 is located above the liquid portion 6 and a liquid-vapor interface 19, which is generally horizontal, separates the two phases (free surface of the liquid in the tank).

In a microgravity environment (weightlessness), the liquid portion is contained in a porous material and the gas portion occupies the remainder of the volume of the tank; in this case as well there is a liquid-vapor interface 19, but it is not planar.

The temperature of this separation surface 19 is related one-to-one to the partial pressure P1 of the working fluid in the gas portion; this pressure corresponds to the saturation pressure Psat of the fluid at the prevailing temperature Tsat at the separation surface 19, as can be seen in FIG. 2, on the left.

In practice, the temperature of the liquid portion, the gas portion and the envelope of the tank are relatively homogeneous; there is little or no temperature gradient inside the tank. Additionally the temperature of the tank is not far from the ambient temperature in which it is located.

According to an advantageous aspect of the present invention, the inlet/outlet orifice 31 is laid out in the area of the liquid portion, such that the gas portion is never directly connected with the liquid connection circuit 5. The configuration of the capillary link between the tank and the porous mass can be like that described in the European patent EP 0832411.

According to a particular aspect, in particular in the case of use in microgravity (scenario not shown in the drawings) but not exclusively, a porous mass 9 can be provided laid out in the area of the inlet/outlet orifice 31, whose function is to retain the liquid and consequently form a barrier blocking gas phase components from being aspirated towards the liquid connection circuit 5.

In terrestrial applications where gravity operates, the inlet/outlet orifice 31 is arranged in the area of a low point of the tank. It should be noted that there can be several low points in the tank.

Figure 3A:
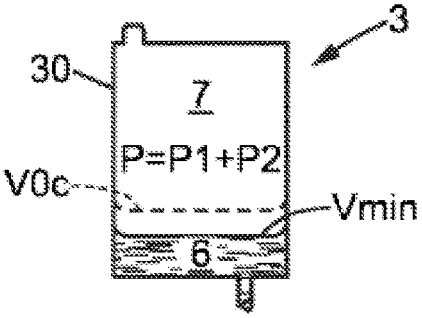
FIGS. 3A and 3B show the tank with a respectively minimum and maximum liquid portion.
Figure 3B:
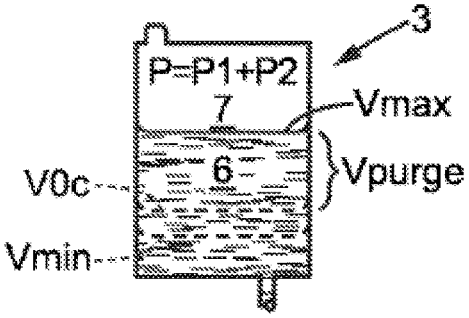

The volume of the liquid portion 6 in the tank can vary between a minimum volume ('Vmin') shown in FIG. 3A which corresponds to a minimum total volume of liquid in the entire general circuit and a maximum volume ('Vmax') shown in FIG. 3B which corresponds to a maximum total volume of liquid in the entire general circuit.

The difference between Vmax and Vmin is at least equal to the sum of two volumes which are called respectively expansion volume V0*c* and purge volume Vpurge which represent respectively first the thermal expansion of liquid and second the drainage of the liquid displaced by the presence of vapor in the vapor conduit 4 and of a portion from the condenser 2 of the loop. In other words, when the two-phase loop is at rest for some time, there is no more vapor in the loop and the liquid occupies all the volume inside the loop which gives a small liquid portion volume in the tank; inversely, when the thermal flow is maximal (Q=Qmax), the first connection circuit 4 is completely filled by the vapor along with a portion of the condenser circuit 2 and because of that the liquid is pushed back into the tank where it occupies a large volume. The volume of the liquid portion is also influenced by the ambient temperature, which results in the expansion volume V0*c*.

Figure 5A:
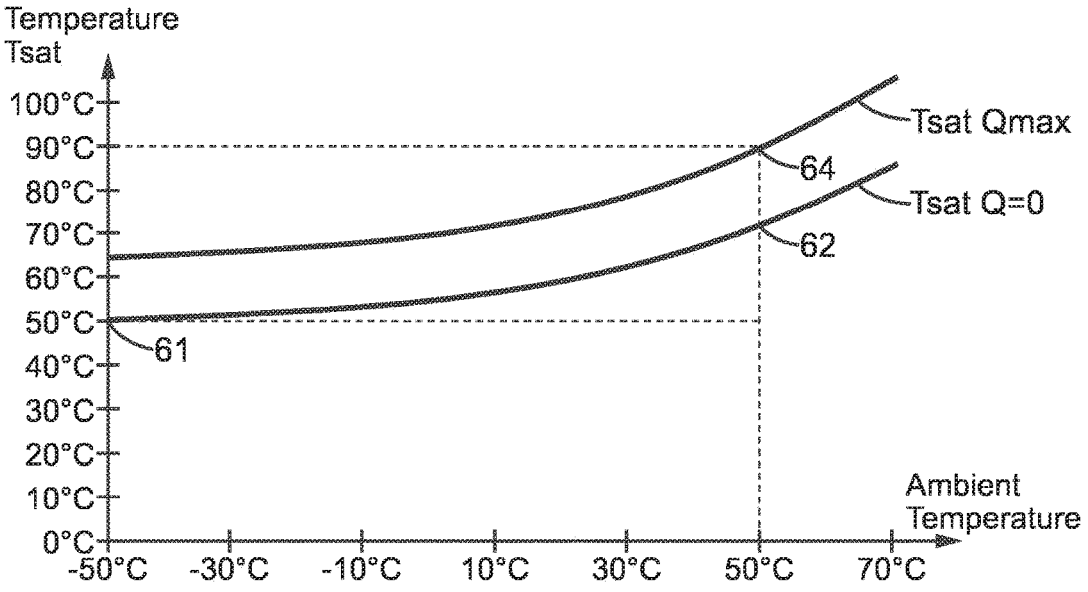
FIGS. 5A and 5B show diagrams of saturation pressure and temperature as a function of ambient temperature.
Figure 5B:
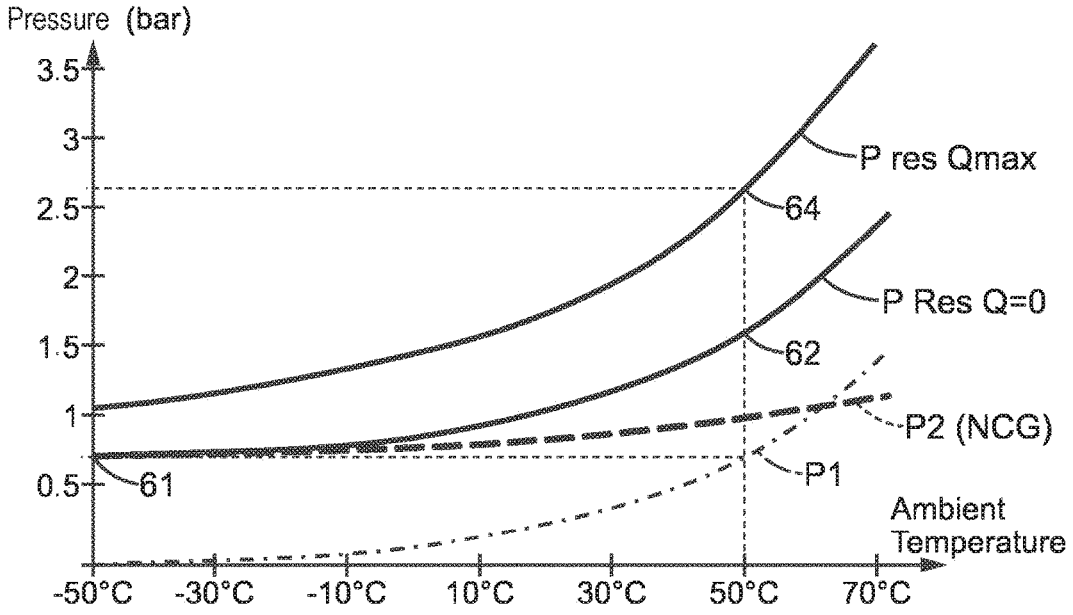

More precisely, the minimum volume Vmin corresponds to a minimum ambient temperature and a zero thermal flow (Q=0) into the evaporator; this situation is shown in FIGS. 5A-5B by the points 61. Note that the dominant pressure in the gas portion is essentially due to the presence of auxiliary gas 8 (pressure P2) and not to the partial pressure P1 of the working fluid, which is very low. The total pressure exerted in the tank is Ptank=P1+P2; it is also substantially the pressure exerted everywhere else in the two-phase loop.

Still without addition of heat to the evaporator (zero thermal flow, Q=0), but with a maximum ambient temperature, an expansion of the liquid is observed which gives a liquid portion volume written V0*c*, greater than Vmin. This situation is shown in FIGS. 5A-5B by the points 62.

Under circumstances where the ambient temperature is maximal and the thermal flow is itself also maximal Q=Qmax, the volume of the liquid portion is increased by the volume corresponding to the purge Vpurge, which leads to the case shown in FIG. 3B. This situation is shown in FIGS. 5A-5B by the points 64.

It can therefore be seen that, when the liquid portion 6 is at the minimum volume (Vmin) thereof which corresponds to a minimum total volume of liquid in the entire general circuit, the second pressure P2 is such that it is possible to get a total pressure in the tank greater than or equal to a required preset minimum operating pressure (shown at 0.7 bar in FIG. 5B as a nonlimiting example; in fact this minimum value can be set according to the application considered).

It can also be seen that, in an illustrative example, when the liquid portion 6 is at the minimum volume (Vmin) thereof, the second partial pressure P2 (NCG) is greater than the first partial pressure P1. This condition continues to be satisfied over a major portion of the ambient temperature range at Q=0 and even over the cold temperatures when Q=Qmax.

It can thus be observed that when the liquid portion is at the minimum volume (Vmin) thereof, the second partial pressure P2 (NCG) can be several times, for example 5 or 10 times, greater than the first partial pressure P1 (see point 61).

The minimum pressure related to the presence of the non-condensable auxiliary gas in the tank (0.7 bar in the example from FIG. 5B) serves to get a high saturation temperature in the second connection circuit (50° C. in the example from FIG. 5A), which makes it possible to get a minimum density p of the vapor phase of the working fluid, and given that the heat transport capacity of the loop is proportional to the vapor phase density (Q=ρVS), instantly upon cold startup of the loop a heat transport capacity can be obtained sufficient to avoid loss of priming of the evaporator and to get a good loop yield.

In order to keep satisfactory thermal evacuation performance in the most constraining thermal case (maximum ambient temperature and maximum thermal flux), shown by the points 64, it is necessary to provide a volume of the gas portion 7 sufficiently above the volume of the liquid portion Vmax.

Advantageously, it can be provided that the total volume 30 of the tank is included between 1.3 and 2.5 times said maximum volume Vmax of the liquid portion (case of the maximum total volume of liquid phase). Thus the saturation temperature Tsat, for an ambient temperature of 50° C. and a maximum flux Qmax, remains below 90° C., which allows continued collection of calories at the hot source 11.

As for the selection of non-condensable auxiliary gas 8, this gas must remain in the vapor phase over the full operating range of the loop and in particular for the pressure and temperature conditions in the tank and it must have a very low boiling point; additionally the coefficient of diffusion thereof into liquids and the Oswald coefficient thereof must also be very low in order to avoid infiltration of this auxiliary gas inside the liquid portion 6 of the tank and into the remainder of the loop.

Advantageously, helium can be selected as auxiliary gas. Helium is chemically neutral and its industrial availability is satisfactory. However, using other gases like nitrogen, argon or neon is not excluded.

Figure 4:
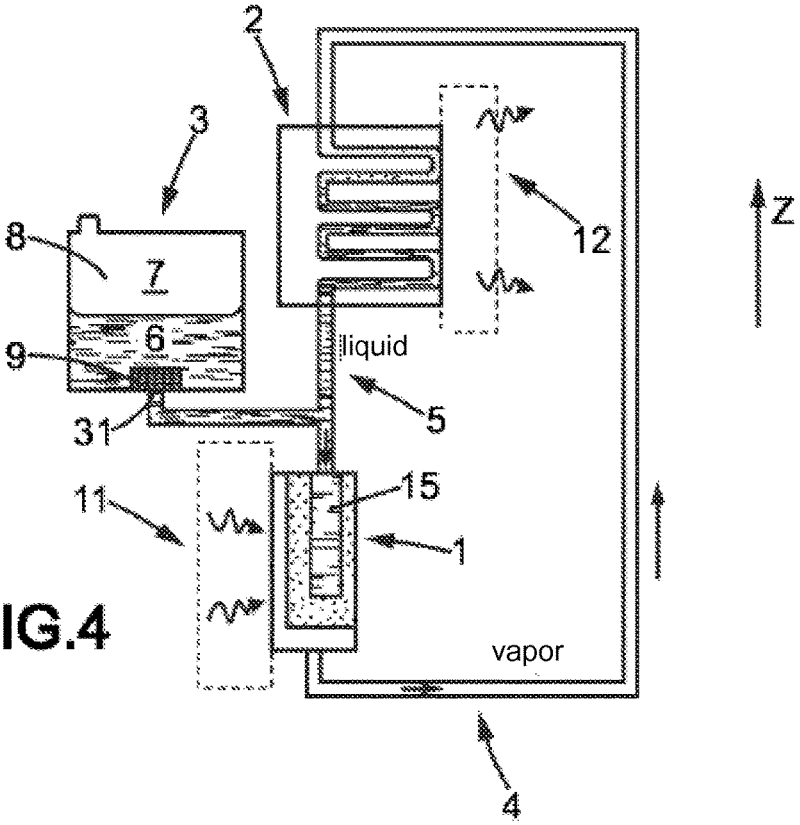
FIG. 4 shows a second embodiment of the device.

FIG. 4 shows a second embodiment of thermosiphon type, in which the condenser 2 is placed above the evaporator 1 such that gravity naturally drives the liquid in the direction of the evaporator; under these conditions the role of the porous material in the evaporator is to promote thermal exchanges and vaporization instead of performing the capillary pumping function itself. Apart from the source of liquid movement and the relative position of the elements which vary, all the rest and in particular the operation is identical to the first embodiment described above and will therefore not be repeated.

Because of the pressurization exerted by the presence of the auxiliary gas 8, it is possible to do away with the presence of a heating element for conditioning the two-phase loop before effective thermal startup.

It also needs to be remarked that such a two-phase loop can do without active regulation, which is a decisive advantage for reliability.

Advantageously according to the invention, the device does not have any mechanical pump although the invention does not exclude the presence of a supplemental mechanical pump.

It needs to be noted that the proportions of the elements in the drawings are not necessarily representative of the proportions or relative dimensions of the various members.

The first and second fluid connection circuits 4, 5 are preferably tubular conduits, but it could be a matter of other types of fluid connection conduits or channels (e.g. rectangular conduits, flexible tubes, etc.). Similarly, the inlet/outlet orifice 31 could have the form of a distinct inlet and outlet.

The two-phase loop could be advantageously equipped with an anti-backflow valve 18 located at the entry of each evaporator so as to increase the maximum startup power. In fact, the anti-backflow valve 18 blocks liquid backflow in the direction opposite to the normal circulation direction, and thus blocks drying of the evaporator on start up under heavy load.

In an application subject to gravity, the anti-backflow valve can be formed by a floating element restored by a buoyancy force against a gate for closing the passage and thus blocking liquid backflow.

It is remarked that advantageously according to the invention the two-phase fluid system presented here is completely self-adapting and does not require any command law or any sensor. The result of this is a particularly simple design, particularly simple manufacturing, an absence of maintenance needs and an incomparable reliability.

The invention claimed is:

1. A device for heat transfer, suited for extracting heat from a hot source and for returning this heat to a cold source via a two-phase working fluid contained in a general closed circuit, comprising:

at least one evaporator, having an inlet and an outlet, at least one condenser, separate from and away from the evaporator, a tank with an internal volume , the internal volume including a liquid portion and a gas portion, and at least one inlet/outlet orifice laid out near the liquid portion, where the liquid portion has a volume that can vary between a minimum volume and a maximum volume, a first connection circuit for the working fluid in vapor phase, connecting the outlet of the evaporator to an inlet of the condenser;

a second connection circuit, for the working fluid in liquid phase, connecting an outlet from the condenser to the tank and to the inlet of the evaporator;

wherein the gas portion from the tank includes the vapor phase of the working fluid with a first partial pressure and a non-condensable auxiliary gas with a second partial pressure, where the second partial pressure is set to obtain a total pressure greater than or equal to a preset minimum operating pressure when the liquid portion in the entire general closed circuit is at the minimum volume, the device having no sensor and no active control, and hence operates in a purely passive operating mode, said device being configured to operate in a temperature range from -50° C. to +50° C., wherein:

the internal volume of the tank is fixed and predefined during design for a given application; and the second partial pressure is at least several times greater than the first partial pressure when the liquid portion is at the minimum volume such that the minimum operating pressure is high enough to allow an instantaneous startup under a significant thermal load without preparation.

2. The device according to claim 1, wherein the non-condensable auxiliary gas is helium.

3. The device according to claim 1, wherein the working fluid is methanol.

4. The device according to claim 1, wherein the total volume of the tank is between 1.3 and 2.5 times said maximum volume of the liquid portion.

5. The device according to claim 1, mainly subject to terrestrial gravity, wherein the inlet/outlet orifice is arranged in an area of a low point of the tank.

6. The device according to claim 1, mainly subject to microgravity, wherein the tank comprises a porous mass laid out at least in an area of the inlet/outlet orifice.

7. The device according to claim 1, wherein the evaporator includes a micro-porous mass adapted for assuring capillary pumping of the liquid phase working fluid.

8. The device according to claim 1, subject mainly to gravity, wherein the evaporator is placed below the condenser and the tank, whereby gravity is used for moving the liquid phase working fluid towards the evaporator.

9. The device according to claim 1, wherein an anti-backflow valve is laid out at the inlet of the evaporator.

* * * * *